United States Patent [19]

Reist

[11] Patent Number: 4,678,174

[45] Date of Patent: Jul. 7, 1987

[54] APPARATUS FOR PICKING-UP AND FURTHER TRANSPORTING, FOLDED PRINTED PRODUCTS, ESPECIALLY SIGNATURES OR SHEETS, FROM A CONVEYING DEVICE

[75] Inventor: Walter Reist, Hinwil, Switzerland

[73] Assignee: Ferag AG, Hinwil, Switzerland

[21] Appl. No.: 897,419

[22] Filed: Aug. 18, 1986

[30] Foreign Application Priority Data

Aug. 29, 1985 [CH] Switzerland ..... 03708/85

[51] Int. Cl.[4] ..... B65H 39/02

[52] U.S. Cl. ..... 270/54; 270/57

[58] Field of Search ..... 270/53–58; 198/644

[56] References Cited

U.S. PATENT DOCUMENTS

| | | | |
|---|---|---|---|
| 2,160,830 | 6/1939 | Christensen | 270/53 |
| 3,580,562 | 5/1971 | Reist | 270/54 |
| 3,692,301 | 9/1972 | Wetter | 270/55 |
| 3,722,877 | 3/1973 | Wetter | 270/54 |
| 3,951,399 | 4/1976 | Reist | 270/58 |
| 4,029,309 | 6/1977 | Lynch | 270/53 |

FOREIGN PATENT DOCUMENTS

| | | | |
|---|---|---|---|
| 358444 | 1/1962 | Switzerland | 270/57 |
| 396816 | 8/1933 | United Kingdom | 270/53 |

*Primary Examiner*—E. H. Eickholt

*Attorney, Agent, or Firm*—Werner W. Kleeman

[57] ABSTRACT

Intermediate or end products comprising a plurality of interstuffed and overlapping folded printed signatures or sheets are straddlingly fed or conveyed by a plurality of collating conveyors of a circulatingly driven collating cylinder or drum to a product transfer location or pick-up region. At the product pick-up region the intermediate or end products are picked-up or taken-over by a product withdrawal conveyor or device. The product withdrawal conveyor comprises holding or gripping mechanisms which are mounted in spaced relationship on a traction member. These holding mechanisms comprise pivotable clamping mechanisms which are laterally pivotable into a location between the halves or portions of the folded products. These halves or portions are raised or separated from each other. These clamping mechanisms press and thus clamp the intermediate or end products against a counter-element. A complete closure of the intermediate or end products is thus prevented by the clamping mechanisms inserted between the product halves or portions. The product halves or portions are spread apart by pivoting the clamping mechanisms together with the counter-elements about a pivot axis. This product spreading action allows transfer of the intermediate or end products while in an open condition to a further collating cylinder or similar apparatus.

18 Claims, 5 Drawing Figures

APPARATUS FOR PICKING-UP AND FURTHER TRANSPORTING, FOLDED PRINTED PRODUCTS, ESPECIALLY SIGNATURES OR SHEETS, FROM A CONVEYING DEVICE

CROSS-REFERENCE TO RELATED APPLICATIONS

This application is related to the commonly assigned, co-pending U.S. patent application Ser. No. 877,359, filed June 23, 1986 and entitled "METHOD AND APPARATUS FOR COLLATING FOLDED PRINTED PRODUCTS, ESPECIALLY SIGNATURES OR SHEETS", the commonly assigned co-pending U.S. patent application Ser. No. 877,360, filed June 23, 1986, and entitled "METHOD AND APPARATUS FOR OPENING PRINTED PRODUCTS WHICH HAVE BEEN FOLDED OFF-CENTER", and the commonly assigned, co-pending U.S. patent application Ser. No. 889,221, filed July 25, 1986, and entitled "APPARATUS FOR COLLATING FOLDED PRINTED PRODUCTS, ESPECIALLY SIGNATURES OR SHEETS", the disclosures of which are incorporated herein by reference.

BACKGROUND OF THE INVENTION

The present invention relates to a new and improved apparatus for picking-up and further transporting folded printed products, especially signatures or sheets, from a conveying device.

Generally speaking, the apparatus of the present invention is for picking-up and further transporting folded printed products, especially signatures or sheets, from a conveying device. These printed signatures or folded sheets are straddlingly conveyed by the conveying device with their folded edges substantially mutually aligned in the direction of conveyance of the conveying device. The apparatus of the present invention comprises a product pick-up means or lifting or elevating device for lifting the printed signatures or folded sheets by entering between the product halves or portions.

Furthermore, a conveying or transporting device is provided for grasping the raised or lifted printed signatures or sheets and for further transporting these printed signatures or sheets.

Known apparatuses of this type, as described, for example, in the Swiss Pat. No. 358,100, granted Nov. 15, 1961 and the Swiss Pat. No. 459,270, granted July 15, 1968, pick-up or lift the printed signatures or sheets from endless, circulatingly driven transport or conveyor chains by raising or lifting a pick-up element or sword-like member. The printed signatures or sheets, which as a rule comprise a plurality of interstuffed or interlined printed signatures or sheets, are further transported by means of this sword-like member. The sword-like member is positioned between the transport or conveyor chains and prior to or upstream of the return or deflection of the path of these transport chains. The printed signatures or sheets are delivered or conveyed to a conveyor arrangement with their folded edges leading. This conveyor arrangement is formed by pairs of conveyor rollers or by conveyor bands or straps coacting with pairs of conveyor rollers. Subsequent to or beyond this conveyor arrangement there is located a further conveyor band or strap.

The intermediate or end products pass through the conveyor gap formed by the pairs of conveyor rollers or the conveyor bands or straps coacting with conveyor rollers. By means of this action, the product halves, which at the moment of their pick-up or lifting from the transport chains are still separated or spread apart from one another, are completely laid upon each other. In other words, the previously opened intermediate or end products are in this manner again closed. Any re-opening of these printed products would thus involve considerable processing effort.

SUMMARY OF THE INVENTION

Therefore, with the foregoing in mind, it is a primary object of the present invention to provide a new and improved construction of an apparatus for picking-up and further transporting folded printed products, especially signatures or sheets, from a conveying device and which apparatus which does not exhibit the aforementioned drawbacks and shortcomings of the prior art constructions.

Another and more specific object of the present invention aims at providing a new and improved construction of an apparatus of the previously mentioned type which permits the printed signatures or sheets which are picked-up from the conveying device to either remain open or to be opened, as required.

Yet a further significant object of the present invention aims at providing a new improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that the transporting device comprises a product withdrawal conveyor for removing, i.e. picking-up or taking over, the intermediate or end products from the pick-up or elevating device. The product withdrawal conveyor has a plurality of controllable holding mechanisms mounted on a circulatingly driven traction member. The holding mechanisms can laterally enter between the product halves or portions and clamp the printed signatures or sheets at their folded edges.

The holding mechanisms of the product withdrawal conveyor or device enter between the product halves or portions of the printed signatures or sheets and thus prevent a complete closure of the printed signatures or sheets. The printed signatures or sheets which are held at their folded edges by means of the holding mechanisms can be easily opened by pivoting the holding mechanisms about an axis which is substantially transverse, typically at right angles to the direction of conveyance of the product withdrawal conveyor or device and is substantially parallel to the folded edges of the printed signatures or sheets. This pivoting movement causes one product half or portion to be lifted or raised from the other product half or portion, i.e. opens the product.

The apparatus according to the invention is particularly advantageous when employed in conjunction with a collating apparatus provided with a plurality of collating conveyors which extend substantially parallel to one another and to a common axis of revolution. These collating conveyors are annularly positioned about this common axis of revolution and are revolvingly driven about this common axis of revolution during conveyance of the printed signatures or sheets. A single product withdrawal conveyor or device is sufficient for picking-up and further transporting the intermediate or end products which comprise a plurality of interstuffed or interlined printed signatures or sheets from the different collating conveyors. A pick-up or lifting device for the printed signatures or sheets is associated with each of these different collating conveyors.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
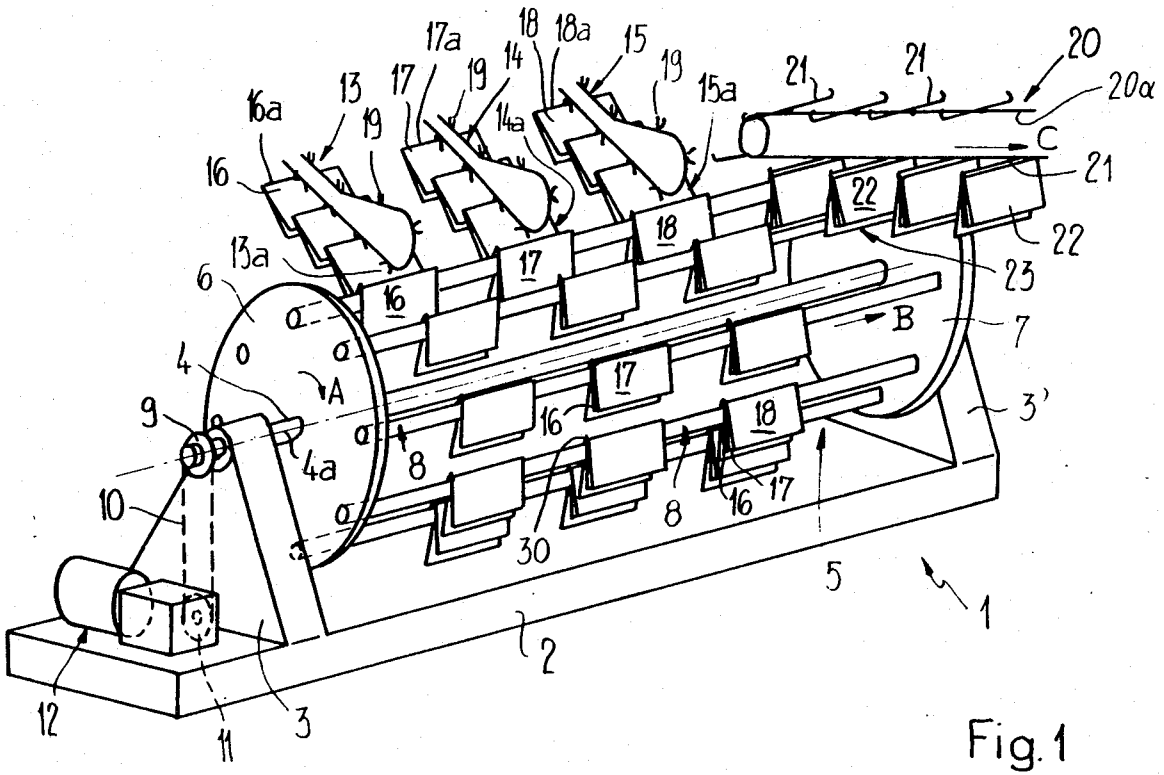
FIG. 1 is a perspective view of a collating apparatus.

Describing now the drawings, it is to be understood that to simplify the showing thereof only enough of the structure of the apparatus for picking-up and further transporting folded printed products, especially signatures or sheets, from a conveying device has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a collating apparatus 1. This collating apparatus 1 comprises a base plate or stand 2 having bearing pedestals or stands 3 and 3' in which a shaft 4 of a collating drum or cylinder 5 is journaled or supported. Two discoidal supporting or support elements 6 and 7 are attached to the shaft 4 and mutually separated by a predetermined spacing. A plurality of collating conveyors 8, whose design and construction will be further described in reference to FIG. 2 hereinbelow, extend between these supporting or support elements 6 and 7.

The collating conveyors 8 are disposed substantially parallel to one another and to the shaft 4 of the collating drum or cylinder 5 and are annularly positioned around this shaft 4. A sprocket or sprocket wheel 9 is mounted on the shaft 4. A chain 10 engages and travels around the periphery of the sprocket or sprocket wheel 9 and a further sprocket or sprocket wheel 11. The sprocket wheel 11 is mounted on a not particularly referenced drive shaft of a drive means 12. The collating drum or cylinder 5 together with the collating conveyors 8 are rotationally or circulatingly, i.e. revolvingly, driven by means of the drive means 12 in the direction of revolution A about a common axis of revolution 4*a* substantially coincident with the longitudinal axis of the shaft 4.

A plurality of, for instance, three feeding conveyors or infeed devices 13, 14 and 15 for infeeding folded printed signatures or sheets 16, 17 and 18, respectively, is positioned one behind the other as seen in the direction of the longitudinal axis of the shaft 4, i.e. also as seen in the direction of conveyance B of the collating conveyors 8. The schematically illustrated feeding conveyors or infeed devices 13, 14 and 15 end or terminate in the vicinity of the outer circumference or periphery of the collating drum or cylinder 5. The regions in the vicinity of the outer circumference or periphery of the collating drum or cylinder 5 located between the collating drum or cylinder 5 and the infeed devices 13, 14 and 15 define respective transfer regions 13*a*, 14*a* and 15*a* for the printed signatures or sheets 16, 17 and 18.

Each feeding conveyor or infeed device 13, 14 and 15 comprises grippers or gripping elements 19 positioned with substantially equal mutual spacing or separation along a not particularly referenced circulatingly driven traction member. These grippers or gripping elements 19 grasp or hold the conveyed printed signatures or sheets 16, 17 and 18 at their respective spine edges or backbones 16*a*, 17*a* and 18*a* and deliver or convey these printed signatures or sheets 16, 17 and 18 such that the open or fan edges which are opposite to the spine edges or backbones 16*a*, 17*a* and 18*a* lead in the direction of product delivery or travel. Conventional opening or spreading devices which are not particularly shown in FIG. 1 open the printed signatures or sheets 16, 17 and 18 and deposit them onto the collating conveyors 8 or onto the respective printed signatures or sheets previously deposited on the collating conveyors 8.

When seen in the direction of conveyance B of the collating conveyors 8 there is positioned behind the last infeed device 15 shown in FIG. 1 a schematically illustrated product withdrawal device or conveyor 20. This product withdrawal device or conveyor 20 comprises holding mechanisms 21 positioned with substantially equal mutual spacing or separation along and connected to a circulatingly driven traction member 20*a*. These holding mechanisms 21 circulate in the direction of conveyance C. The design of the product withdrawal device or conveyor 20 will be described in more detail hereinbelow in relation to FIGS. 2 and 3.

The holding mechanisms 21 pick-up intermediate or end products 22 each comprising a plurality of overlapping or interstuffed printed signatures or folded sheets 16, 17 and 18 in a pick-up region or transfer location 23 in a manner which will be described in more detail hereinbelow. The holding mechanisms 21 convey or deliver these printed signatures or folded sheets 16, 17 and 18 to a second collating drum or cylinder as will be described in more detail hereinbelow in reference to FIG. 5.

Figure 2:
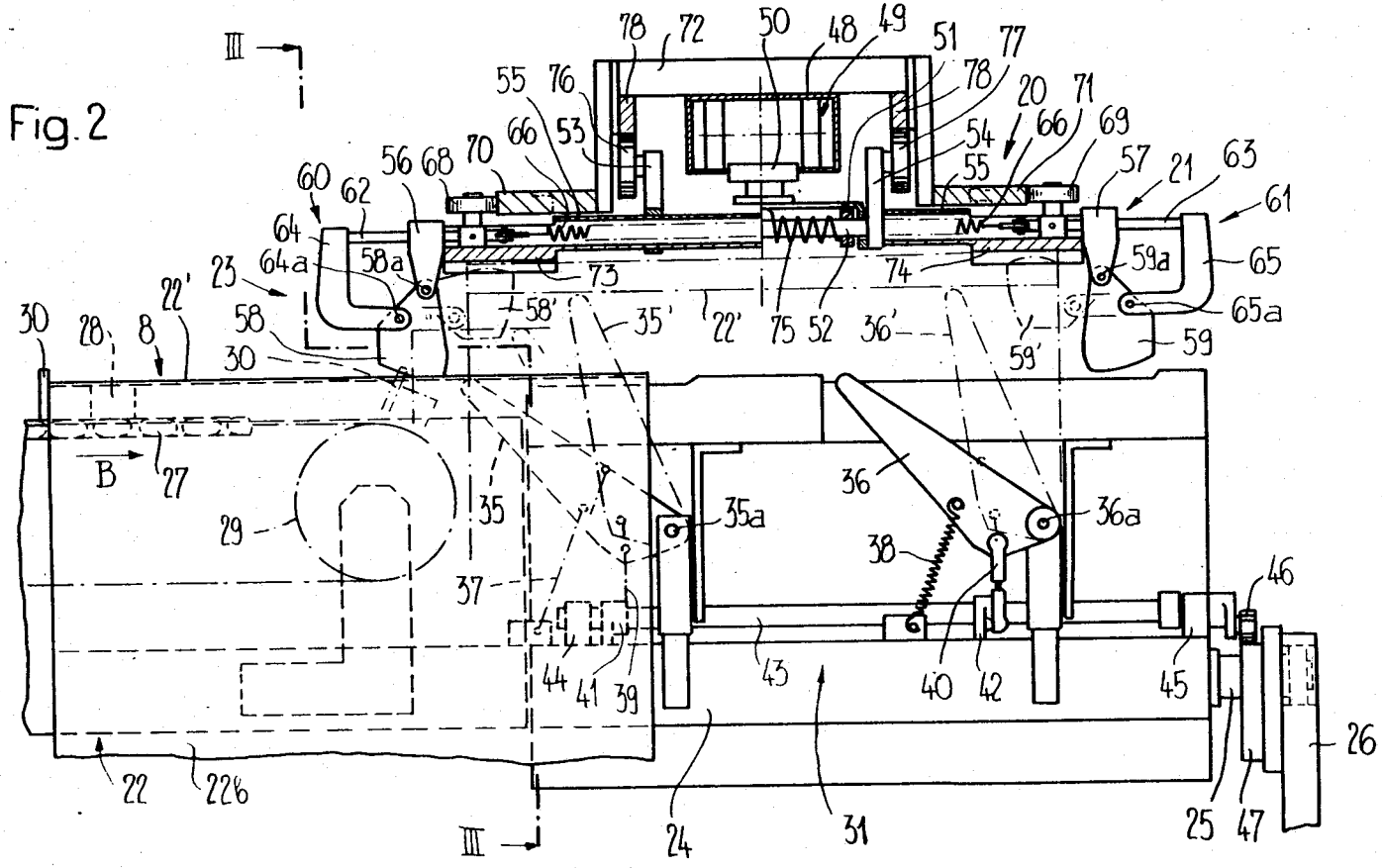
FIG. 2 is a side view of the delivery or transfer end of the collating cylinder or drum of the collating apparatus illustrated in FIG. 1 and the product withdrawal conveyor or device shown in partial section and on an enlarged scale relative to FIG. 1.
Figure 3:
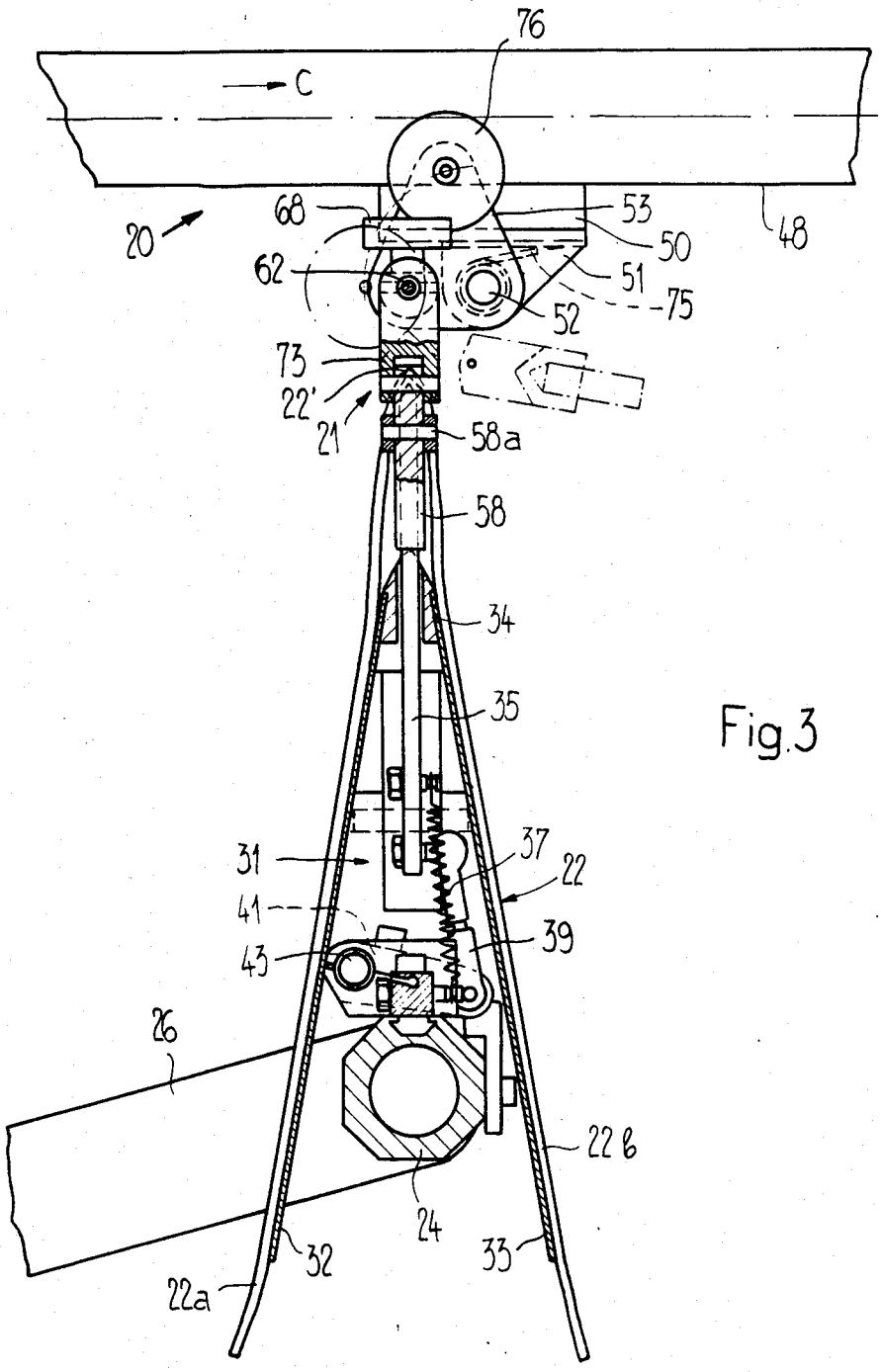
FIG. 3 is a section of the product withdrawal conveyor or device taken substantially along the line III—III in FIG. 2.

FIG. 2 shows a side view of a collating conveyor 8 of the collating drum or cylinder 5 in the pick-up region or transfer location 23 and the product withdrawal device or conveyor 20 in partial section, and FIG. 3 shows a section taken approximately along the line III—III in FIG. 2.

In reference to FIGS. 2 and 3, it will be seen that each collating conveyor 8 comprises a continuous support tube or profile 24 which extends the entire length of the collating conveyor 8. This support tube 24 is mounted at both ends in pivoting levers 26 by means of journal pins or stub shafts 25. These pivoting levers 26 are pivotably mounted on the supporting or support elements 6 and 7 (cf. FIG. 1) in a manner which is not here particularly described since it does not constitute subject matter of the present invention. For further details, reference may be had to the initially cross-referenced related applications.

A drive means or drive arrangement which is also not here particularly described but which is described in detail in the aforesaid related U.S. patent application Ser. No. 889,221, filed July 25, 1986, rotates the collating conveyors 8 about their journal or stud pins 25 during their revolution about the common axis of revolution 4*a* such that the collating conveyors 8 substantially maintain their upright orientation in space.

Each collating conveyor 8 comprises a continuous or endless conveyor element or chain 27 which is circulatingly driven in the direction of conveyance B. This conveyor chain 27 is provided with rest or support elements or members 28 for the printed signatures or sheets 16, 17 and 18. The conveyor chain 27 travels over guide sprockets or wheels 29. As seen in the direction of conveyance B the rear guide sprocket or wheel 29 is indicated with a dotted and dashed annular line at the left side of FIG. 2. The conveyor chain 27 is further provided with entrainment means 30 positioned with substantially equal mutual spacing or separation.

These entrainment means 30 engage the rear or trailing edges of the respective printed signatures or sheets 16, 17 and 18 or the end products 22 as seen in the direction of conveyance B of the collating conveyors 8. The power or drive means for the conveyor chains 27 is derived from the rotary motion of the collating conveyors 8 about their journal or stud pins 25 during their revolution about the common axis of revolution 4*a* of the collating drum or cylinder 5 as is further described in the aforementioned related U.S. patent application Ser. No. 877,359, filed June 23, 1986. This drive means of the conveyor chains 27 is not here particularly shown or described since it does not constitute subject matter of the present invention.

Each collating conveyor 8 comprises a pick-up or lifting device or elevating means 31. When seen in the direction of conveyance B of the collating conveyors 8, this pick-up elevating device 31 is positioned subsequent to or beyond the rear guide sprocket or wheel 29. The pick-up elevating device 31 is arranged between two surfaces or walls 32 and 33 which are in the shape of a peaked or saddle-shaped roof. These surfaces or walls 32 and 33 are attached at their upper ends to a support or supporting ridge 34 as will be seen in reference to FIG. 3. The surfaces or walls 32 and 33 serve as a carrying or support surface for product halves portions 22*a* and 22*b* of the intermediate or end products 22.

The pick-up elevating device 31 comprises two elevating fingers or elements 35 and 36, respectively, which are positioned in spaced relationship one after another as seen in the direction of conveyance B of the collating conveyors 8. These elevating fingers 35 and 36 are pivotably journaled about respective axes 35*a* and 36*a* to be pivotable between a lower end position illustrated in dashed and solid lines, respectively, and an upper end position illustrated with chain-dotted lines and having the respective reference numerals 35' and 36'. Respective tension springs 37 and 38 act upon the elevating fingers 35 and 36 and hold or pre-bias these elevating fingers 35 and 36 in their lower end positions. Respective coupling members 39 and 40 engage the elevating fingers 35 and 36 at a spacing or separation from the respective pivot axes 35*a* and 36*a*. At the other ends of these coupling members 39 and 40 there are connected respective transmission levers 41 and 42. The transmission levers 41 and 42 are positioned on an actuation or control rod 43. This actuation or control rod 43 is pivotably journaled in bearing bushings 44 and 45 which are attached to the support tube 24. As seen in the direction of conveyance B of the collating conveyors 8 there is positioned at the exterior or outward end of this actuation or control rod 43 a control roll or roller 46 coacting with a control disc or cam 47. This control disc or cam 47 is mounted on the journal pin or stub shaft 25 and co-rotates with the journal pin or stub shaft 25 during the revolution of the collating conveyors 8 about the common axis of revolution 4a.

As soon as each collating conveyor 8 arrives in the transfer location or pick-up region 23, the control disc or cam 47 causes a rotation of the control or actuation rod 43 by means of the control roll or roller 46. This turning or rotation of the actuation rod 43 results in an upward pivoting or swinging of the elevating fingers 35 and 36 into the respective upper end positions 35' and 36' counter to the resilient force of the respective tension springs 37 and 38 by means of the respective transmission levers 41 and 42 and the respective coupling members 39 and 40. After departing the H pick-up region 23, the elevating fingers 35 and 36 are again swung or pivoted back into the lower end positions.

The design of the product withdrawal conveyor or device 20 will be described in more detail hereinbelow.

The product withdrawal conveyor or device 20 comprises a chain 49 guided in a channel 48 provided for the chain 49. Holding mechanisms 21 are attached with substantially equal mutual spacing or separation along the chain 49. The chain 49 is circulatingly driven in the direction of conveyance C of the product withdrawal conveyor or device 20 (cf. FIG. 3) in a conventional manner which is not here particularly shown or described, for instance by a motor-driven sprocket. Attachment or mounting elements 50 are attached to the chain 49 for mounting the holding mechanisms 21 thereto. Bushing or bearing elements 51 for a rotatable pivot shaft 52 are attached to these attachment or mounting elements 50 (cf. right half of the partial section shown in the upper half of FIG. 2).

Two mounting or support plates 53 and 54 which are arranged in mutual spaced relationship are connected with this rotatable pivot shaft 52. A tubular arm 55 is positioned or held in these mounting or support plates 53 and 54. This tubular arm 55 extends substantially transverse to the direction of conveyance C of the product withdrawal conveyor or device 20. At the ends of this tubular arm 55 there are attached mounting or support elements 56 and 57. Clamping mechanisms 58 and 59, respectively, are pivotably mounted on these mounting or support elements 56 and 57. The corresponding axes of rotation or pivot axes are designated in FIG. 2 by the reference numerals 58*a* and 59*a*, respectively. Each clamping mechanism 58 and 59 is inwardly pivotable by means of an actuation or control mechanism 60 and 61, respectively, from a release position indicated in solid lines to a clamping position designated by the respective reference numerals 58' and 59' and illustrated with chain-dotted lines.

Each actuation or control mechanism 60 and 61 comprises a respective actuation or control rod or element 62 and 63 which is displaceable in the longitudinal direction of the tubular arm 55. These actuation or control rods 62 and 63 possess at their outer ends respective bent connecting pieces or coupling members 64 and 65 which are pivotably connected at the mounting points designated by the respective reference numerals 64*a* and 65*a* with the respective associated clamping mechanisms 58 and 59. The mounting points 64*a* and 65*a* are positioned in spaced relationship from the respective pivot axes 58*a* and 59*a* of the clamping mechanisms 58 and 59. The other ends of the actuating or control rods 62 and 63 coact with or engage a tension spring 66 which strives to pull the actuating or control rods 62 and 63 inwardly, resulting in a pivoting or swinging of the clamping mechanisms 58 and 59 into the clamping position. The clamping mechanisms 58 and 59 are thus held in their respective clamping positions 58' and 59' by means of the tension spring 66.

Each actuation or control rod 62 and 63 supports a respective control roll or roller 68 and 69 which coacts with respective control curves or cams 70 and 71. These control curves 70 and 71 are attached to a mounting support 72 (cf. FIG. 2). As the control rolls 68 and 69 run off or depart the respective control curves 70 and 71, the actuation or control rods 62 and 63, respectively, are outwardly displaced against the force of the tension spring 66 which results in a pivoting of the clamping mechanisms 58 and 59, respectively, back into the open or release position.

The clamping mechanisms 58 and 59 coact in their respective clamping positions 58' and 59' with respective counter elements 73 and 74. These counter elements 73 and 74 are provided on the tubular arm 55.

A torsion spring 75 is positioned about the pivot shaft 52. This torsion spring 75 is supported at the bushing or bearing element 51. In this manner the torsion spring 75 supports or holds the holding mechanisms 21 and thus the clamping mechanisms 58 and 59, together with the associated counter-elements 73 and 74, in a substantially vertical position. Control rollers or rolls 76 and 77 are attached to the respective mounting or support plates 53 and 54. These control rollers 76 and 77 are intended to coact with cams or camming ramps 78 (cf. FIGS. 2 and 5). These cams 78 cause a pivoting of the holding mechanisms 21 about the pivot shaft 52 in a manner which will be described hereinbelow.

The method of operation of the apparatus according to the invention will now be further discussed hereinbelow as far as this method of operation has not already been described in the preceding description.

As already discussed in reference to FIG. 1, the printed signatures or folded sheets 16, 17 and 18 which are delivered by the respective infeed devices 13, 14 and 15 are successively deposited one over another or collated into the intermediate or end product 22 during their displacement by the collating conveyors 8 in the direction of conveyance B. These intermediate or end products 22 straddlingly resting on the collating conveyors 8 are pushed at the end of the conveyor chains 27 by the entrainment means 30 over the roof-shaped surfaces or walls 32 and 33 upon which there rest the respective product halves or portions 22*a* and 22*b*, as will be seen in reference to FIGS. 2 and 3. This occurs as the intermediate or end products 22 enter into the pick-up region 23.

As previously mentioned, the elevating fingers 35 and 36 are pivoted from their lower end position towards the upper end position during entry of the intermediate or end products 22 resting on the individual collating conveyors 8 into this pick-up region 23. In this manner the elevating fingers 35 and 36 come into contact with the opened intermediate or end product 22 lying thereover at the inside of the folded edge 22' and lift or elevate the intermediate or end product 22. Since the elevating fingers 35 and 36 pivot in the direction of conveyance B of the collating conveyors 8, the intermediate or end products 22 are also further displaced in the direction of conveyance B during this elevating or lifting action.

Figure 4:
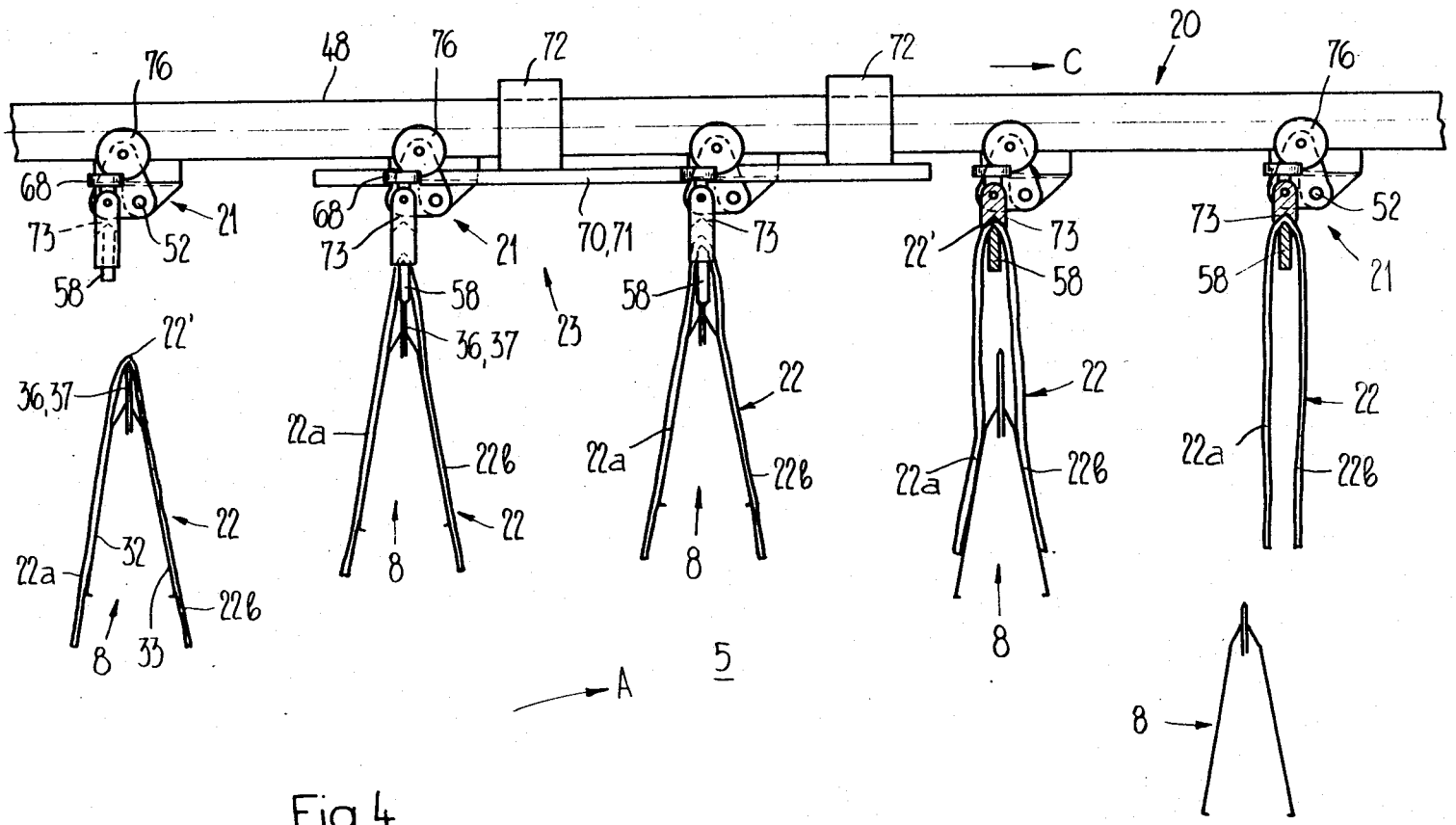
FIG. 4 is a side view of the product pick-up region of the product withdrawal conveyor or device shown in FIGS. 2 and 3 coacting with the conveying devices of the collating cylinder or drum of the collating apparatus shown in FIG. 1.

As will be seen in FIG. 4, the control curves or cams 70 and 71 are positioned in this pick-up region 23 or transfer location. This means that the actuating or control rods 62 and 63 are outwardly displaced during entry of the holding mechanisms 21 into the pick-up region 23. This outward displacement causes a pivoting of the clamping mechanisms 58 and 59 into the open position as will be seen in reference to FIG. 2. In order now to pick-up or transfer the intermediate or end products 22 which have been raised and opened in the manner previously described, the clamping mechanisms 58 and 59 are now laterally inserted between the product halves or portions 22*a* and 22*b*. That is to say, the clamping mechanisms 58 and 59 are pivoted from the open position into the clamping position 58' and 59', respectively, controlled by means of the tension spring 66 and the respective control curves or cams 70 and 71. In this manner the clamped or gripped intermediate or end product 22 is pressed with the folded edge 22' against the associated counter-element 73 and 74, respectively, as will be seen in reference to FIGS. 2 to 4. The intermediate or end products 22 which have been clamped or gripped in this manner are further transported in a suspended or hanging attitude or position in the direction of conveyance C of the product withdrawal conveyor or device 20 and thereby lifted or picked-up from the collating conveyors 8, as can especially be seen in reference to FIG. 4.

The clamping mechanisms 58 and 59 which are located between the product halves or portions 22*a* and 22*b* prevent a total closing or closure of the previously opened intermediate or end products 22 after having been picked-up. The intermediate or end products 22, which comprise a plurality of interstuffed or interlined printed signatures or folded sheets 16, 17 and 18 picked-up from the collating conveyors 8 by means of the holding mechanisms 21, are now transported or conveyed to a further collating apparatus. This further collating apparatus, for instance, substantially corresponds to the initially described collating apparatus 1. A portion of collating conveyors 8' of a collating drum or cylinder 5' of this further collating apparatus is schematically indicated in FIG. 5.

Before transferring the intermediate or end products 22 to the individual collating conveyors 8' of the further collating apparatus, the intermediate or end products 22 are spread or opened mcre widely. In order to accomplish this, the holding mechanisms 21, i.e. the clamping mechanisms 58 and 59, together with their associated counter-elements 73 and 74, are pivoted about the pivot axis 52 as can be seen in the left portion of FIG. 5. The cams or camming ramps 78 upon which the control or follower rolls 76 and 77 travel are provided for this purpose.

Figure 5:
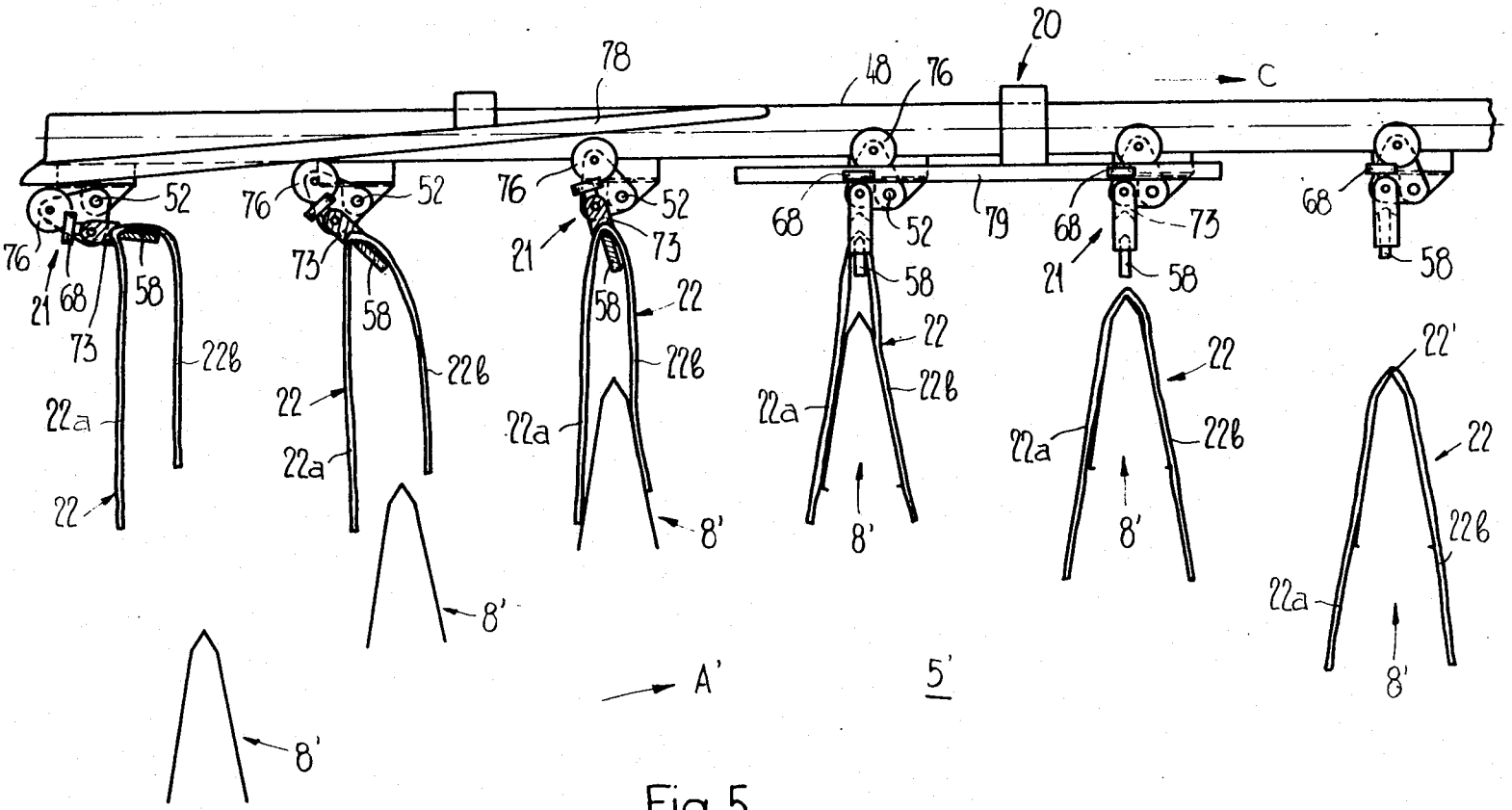
FIG. 5 is an illustration similar to FIG. 4, but showing the product delivery region of the product withdrawal conveyor or device coacting with the conveying devices of a collating cylinder or drum of a further collating apparatus.

This pivoting of the clamping mechanisms 58 and 59 and their associated counter-elements 73 and 74 causes both product halves or portions 22*a* and 22*b* of the clamped intermediate or end product 22 to be clearly separated from one another as will be seen in reference to the left portion of FIG. 5. The individual collating conveyors 8' of the collating drum or cylinder 5' of the further collating apparatus can now readily enter between the product halves or portions 22*a* and 22*b* which have been spread apart in this manner. Each cam or camming ramp 78 is designed such that the holding mechanisms 21 are gradually pivoted back again into the substantially upright position by means of the torsion spring 75 so that the intermediate or end products 22 can straddlingly overlie the collating conveyors 8'.

Subsequent to the cams or camming ramps 78 there are positioned opening cams or cam elements 79 which correspond to the control curves or cams 70 and 71 (cf. FIGS. 2 and 4) and cause an opening of the holding mechanisms 21, i.e. a pivoting or rotation of the clamping mechanisms 58 and 59 from the product clamping position into the product release position. In this manner the intermediate or end products 22 are released and come completely to rest on the collating conveyors 8' as will be seen in the right portion of FIG. 5. The clamping mechanisms 58 and 59 are then again pivoted into their respective clamping position 58' and 59' by means of the tension spring 66 after passage of the respective control or follower rolls 68 and 69 from the opening cams 79.

The intermediate or end products 22 which have been deposited upon the collating conveyors 8' are now further conveyed or transported by means of the collating conveyors 8'. During this further conveyance of the intermediate or end products 22 further printed signatures or sheets can be deposited upon the intermediate or end products 22 in the manner described in reference to FIG. 1.

A complete closure of the still opened intermediate or end products 22 is once again prevented by the lateral entry. of clamping mechanisms 58 and 59 between the product halves or portions 22*a* and 22*b* as previously described. This means that the intermediate or end products 22 are again easily opened after renewed pick-up by means of the holding mechanisms 21.

It is possible for the apparatus according to the invention as previously described to be constructed differently than as exempararily illustrated in the drawings and to be utilized differently. For example, the intermediate or end products 22 picked-up from the product withdrawal conveyor or device 20 can be conveyed to a single stationarily located conveyor rather than to the revolving collating drum or cylinder 5' shown in FIG. 5. Such a stationarily located conveyor would receive the intermediate or end products 22 and would further transport or convey these intermediate or end products 22 at approximately right angles to the direction of conveyance C of the product withdrawal conveyor or device 20. This single conveyor can, for example, be a collating conveyor or can serve as an infeed device to a processing station, for example a stapling or stitching machine and/or a cutting machine. In the latter case, the intermediate or end product 22 would then constitute a final end product 22.

Furthermore, intermediate or end products 22 can be picked-up from a single collating conveyor which is stationarily located by means of the aforedescribed product withdrawal conveyor or device 20 as, for example, hllustrated in the previously mentioned Swiss Pat. Nos. 358,100 and 459,270.

While there are shown and described present preferred embodiments of the invention, it is to be distinctly understood that the invention is not limited thereto, but may be otherwise variously embodied and practiced within the scope of the following claims. ACCORDINGLY, (what I claim is:)

1. An apparatus for picking-up and further transporting folded printed products, especially signatures or sheets, from a conveying device upon which the folded printed products straddlingly rest with folded edges thereof substantially aligned in the direction of conveyance of the conveying device, comprising:

elevating means for elevating the folded printed products;

transport means for further transporting the folded printed products away from the conveying device;

said transport means comprising a product withdrawal device for picking-up the folded printed products from said elevating means by entering between respective product portions of each folded printed product; and said product withdrawal device comprising a circulatingly driven traction member and a plurality of controllable holding means mounted on said circulatingly driven traction member for laterally entering between said respective printed products at folded edges thereof.

2. The apparatus as defined in claim 1, wherein:

said product withdrawal device comprises a plurality of counter-elements for cooperating with said plurality of controllable holding means;

said plurality of controllable holding means comprising a plurality of clamping mechanisms capable of entering between said respective product portions and clamping each said folded printed product against an associated counter-element of said plurality of counter-elements; and each controllable holding means of said plurality of controllable holding means comprising an associated one of said plurality of clamping mechanisms.

3. The apparatus as defined in claim 2, wherein:

said product withdrawal device of said transport means has a direction of conveyance;

each controllable holding means of said plurality of controllable holding means comprising two clamping mechanisms of said plurality of clamping mechanisms arranged to substantially confront each other; and each said clamping mechanism being pivotable between a product clamping position and a product release position thereof.

4. The apparatus as defined in claim 3, wherein:

each said clamping mechanism having means defining a pivot axis which extends substantially transverse to said direction of conveyance of said product withdrawal device;

each said clamping mechanism being pivotable about. said pivot axis;

a respective control mechanism acting in spaced relationship to said pivot axis of each associated one of said clamping mechanisms; and each said clamping mechanism being operatively connected with an associated one of said control mechanisms.

5. The apparatus as defined in claim 4, wherein:
each control mechanism comprises a coupling member;
each said control mechanism further comprises a substantially rod-shaped displaceable control element extending substantially transverse to said direction of conveyance of said product withdrawal device; and
said substantially displaceable rod-shaped, control element being connected with its associated clamping mechanism of said plurality of clamping mechanisms by means of its associated coupling member of said plurality of coupling members such that said associated clamping mechanism is pivoted into said product release position thereof during an extension of said substantially rod-shaped displaceable control element.

6. The apparatus as defined in claim 5, wherein:
said substantially rod-shaped displaceable control. element extends substantially at right angles to said direction 7. The apparatus as defined in claim 6, further including:
a tension spring for exerting a force; and
said extension of said substantially rod-shaped displaceable control element into said product release position. occurring counter to said force of said tension spring.

8. The apparatus as defined in claim 2, wherein:
said plurality of clamping mechanisms being arranged to coact in pairs;
said product withdrawal device of said transport means has a direction of conveyance;
means defining a respective pivot axis extending said product withdrawal device and provided for each coacting pair of clamping mechanisms; and
each controllable holding means of said plurality of controllable holding means and associated with a given pair of said clamping mechanisms being pivotable about an associated one of said pivot axes.

9. The apparatus as defined in claim 8, wherein:
said pivot axis extends substantially at right angles to said direction of conveyance of said product withdrawal device.

10. The apparatus as defined in claim 8, further including:
a plurality of support plates;
each clamping mechanism of said plurality of clamping mechanisms and each therewith associated counter-element of said plurality of counter-elements being connected to an associated support plate of said plurality of support plates which is pivotably connected to said means defining an associated one of said pivot axes;
each support plate of said plurality of support plates having an open position and an idle position; and
each said support plate being held in said idle position for picking-up the printed products and pivotable from. said idle position into said open position from which one of said product portions of the folded printed products being lifted from the other said product portion of the folded printed product by means of entry of one of said plurality of clamping mechanisms.

11. The apparatus as defined in claim 10, further including:
spring means provided for said support plates; and
each said support plate being held by said spring means in said idle position for picking-up the folded printed products by an associated pair of said clamping mechanism.

12. The apparatus as defined in claim 1, wherein:
said elevating means comprises at least one elevating element pivotable in the direction of conveyance of the conveying device from a lower end position into an upper end position; and
said at least one elevating element being insertable between said product portions of the folded printed products during a pivoting motion of said at least one elevating element into said upper end position.

13. The apparatus as defined in claim 12, further including:
a plurality of spring means each exerting a spring force; and
said at least one elevating element being insertable between said product portions of the folded printed products during said pivoting motion into said upper end position counter to the spring force of an associated one of said plurality of spring means.

14. The apparatus as defined in claim 1, wherein:
the conveying device comprises a continuous circulatingly driven conveyor element; and
said elevating means being positioned subsequent to said continuous circulatingly driven conveyor element as seen in the direction of conveyance of the conveying device.

15. The apparatus as defined in claim 14, wherein:.:
said continuous circulatingly driven conveyor element comprises a conveyor chain.

16. The apparatus as defined in claim 1, wherein:
the conveying device is structured as a collating conveyor of a collating apparatus for collating the fblded printed products.

17. The apparatus as defined in claim 1, wherein:
the conveying device is structured as a collating apparatus comprising a plurality of collating conveyors each having a direction of conveyance which is substantially parallel to a common axis of revolution of said plurality of collating conveyors;
said plurality of collating conveyors being substantially annularly arrayed about said common axis of revolution;
said plurality of collating conveyors being circulatingly driven about said common axis of revolution during the conveyance of the folded printed products;
each collating conveyor of said plurality of collating conveyors being associated with a respective elevating means and possessing a pick-up region; and
said elevating means being activated for picking-up the folded printed products when said associated collating conveyor passes through said pick-up region.

18. The apparatus as defined in claim 17, further including:
a control mechanism which is activated by said associated collating conveyor when said associated collating conveyor passes through said pick-up region;
said elevating means comprising at least one elevating element; and
said at least one elevating element being pivotable into said upper end position by means of said control mechanism.

* * * * *

UNITED STATES PATENT AND TRADEMARK OFFICE

CERTIFICATE OF CORRECTION

PATENT NO. : 4,678,174

DATED : July 7, 1987

INVENTOR(S) : WALTER REIST

It is certified that error appears in the above-identified patent and that said Letters Patent is hereby corrected as shown below:

Column 4, line 11, before "positioned" please insert --disposed such that the conveyors or infeed devices are--

Column 5, line 58, after "halves" please insert --or--

Column 6, line 32, before "pick-up" please delete "H"

Column 6, line 50, please delete "partiaI" and insert --partial--

Column 10, line 10, please delete "(what" and insert --What-- and at the end of the line please delete ")" (parenthesis)

Column 10, line 30, after "respective" please insert --product portions of the printed products and clamping the--

Column 11, line 19, please delete "." (period)

Column 11, line 21, after "direction" please insert --of conveyance of said product withdrawal device.--

Column 11, line 27, after "position" please delete "." (period)

Column 11, line 34, after "extending" please insert --substantially transverse to said direction of conveyance of--

Column 11, line 60, after "from" (first occurence) please delete "." (period)

UNITED STATES PATENT AND TRADEMARK OFFICE

CERTIFICATE OF CORRECTION

PATENT NO. : 4,678,174

DATED : July 7, 1987

INVENTOR(S) : WALTER REIST

It is certified that error appears in the above-identified patent and that said Letters Patent is hereby corrected as shown below:

Column 12, line 30, after "wherein:" please delete ".:" (period colon)

Column 12, line 36, please delete "fblded" and insert --folded--.

Signed and Sealed this

Eighth Day of March, 1988

*Attest:*

DONALD J. QUIGG

*Attesting Officer*

*Commissioner of Patents and Trademarks*